US005078525A

United States Patent [19]

Kakuguchi

[11] Patent Number: 5,078,525

[45] Date of Patent: Jan. 7, 1992

[54] PAPER ENTRANCE STRUCTURE FOR PRINTER

[75] Inventor: Kazuhiro Kakuguchi, Kawasaki, Japan

[73] Assignee: Fujitsu Limited, Kawasaki, Japan

[21] Appl. No.: 615,544

[22] Filed: Nov. 19, 1990

[30] Foreign Application Priority Data

Nov. 20, 1989 [JP] Japan ..... 1-301012

[51] Int. Cl.[5] ..... B41J 13/14

[52] U.S. Cl. ..... 400/642; 400/613.1; 400/691; 226/88; 271/19

[58] Field of Search ..... 400/613.1, 613.3, 616, 400/616.1, 616.2, 616.3, 642, 691, 693; 271/19, 21; 226/88, 74, 104

[56] References Cited

U.S. PATENT DOCUMENTS 4,637,537 1/1987 Ikeda ..... 400/616.3 X 4,822,190 4/1989 Yokoi ..... 400/613.3

*Primary Examiner*—Edgar S. Burr

*Assistant Examiner*—E. P. Raciti

*Attorney, Agent, or Firm*—Armstrong, Nikaido, Marmelstein, Kubovcik & Murray

[57] ABSTRACT

An entrance structure for introducing a continuous form paper from a paper feeder into a printer, and comprises an entrance forming member disposed above a front end of the paper feeder and having a sloped guide surface defining an entrance opening for the paper. The sloped guide surface is constituted such that although a leading edge portion of the paper set in the paper feeder is pushed upward, the raised leading edge portion thereof can pass smoothly through the entrance opening.

12 Claims, 4 Drawing Sheets

PAPER ENTRANCE STRUCTURE FOR PRINTER

BACKGROUND OF THE INVENTION

1) Field of the Invention

The present invention relates to an entrance structure for introducing a continuous form paper from a paper feeder into a printer.

2) Description of the Related Art

In general, a serial printer such as a wire dot printer is provided with a paper feeder such as a pin-belt tractor for feeding a continuous form paper to a printing location defined by a platen and a printing head. The pin-belt tractor is disposed at an opening area formed in a housing of the printer to be accessed by an operator, whereby a continuous form paper can be set in the pin-belt tractor. In particular, the pin-belt tractor includes a pair of pin-belt assemblies which are engaged with two rows perforations formed along the side margins of the continuous form paper, respectively, and which are supported by the printer frame to be movable toward and apart from each other, so that respective continuous form papers having various widths can be set in the pin-belt tractor.

Recently, many printers are designed so that an automatic loading of the continuous form paper can be carried out. Namely, when a loading switch of the printer is turned ON, the pin-belt tractor is provisionally driven so that the continuous form paper is automatically moved to the printing location, whereby the continuous form paper is made ready for printing. During the automatic movement of the continuous form paper to the printing location, the continuous form paper is first introduced into an interior of the printer housing through an entrance opening formed therein, and then is guided to the printing location along a guide path extended from the entrance theretoward.

The setting of the continuous form paper in the pin-belt tractor is carried out in such a manner that it is tightened between the pin-belt assemblies thereof. Nevertheless, a leading edge portion of the continuous form paper may be misaligned because a width thereof is made greater due to a rise in an air moisture content. In this case, the misaligned leading edge portion of the continuous form paper may be jammed against an upper edge of the entrance opening, resulting in a jam of the continuous form paper thereat. For this reason, the entrance opening is conventionally defined by a sloped guide surface formed on a guide surface forming member. In particular, the guide surface forming member, which may form a part of the printer housing, is disposed above a front end of the pin-belt tractor and has an angle of elevation with respect to the pin-belt tractor. This sloped guide surface enables the smooth passage of the misaligned leading edge portion of the continuous form paper through the entrance opening.

Nevertheless, to ensure a smooth passage of the misaligned leading edge portion of the continuous form paper, the angle of elevation of the sloped guide surface must be as gradual as possible, and in general, is from about 20 to about 30 degrees. Also, to prevent a jamming of a top of the misaligned leading edge portion against an outside edge boundary of the sloped guide surface, a distance between the outside edge of the sloped guide surface and a plane of the continuous form paper must be as high as possible. Before these requirements can be met, the printer housing must be extended at a rear side thereof at which the pin-belt tractor is disposed, resulting in an undesirable bulkiness of the printer housing.

SUMMARY OF THE INVENTION

Therefore, an object of the present invention is to provide an entrance structure for introducing a continuous form paper from a paper feeder into a printer, which structure is arranged such that a misaligned leading edge portion of the continuous form paper can smoothly pass therethrough, and a bulk of a housing of the printer is not increased.

In accordance with the present invention, there is provided an entrance structure for introducing a continuous form paper from a paper feeder into a printer, which structure comprises an entrance forming member disposed above a front end of the paper feeder and having a sloped guide surface defining an entrance opening for the paper. The sloped guide surface includes side surface sections and a central surface section therebetween, which have different angles of elevation with respect to the paper feeder, respectively. The angle of elevation of the central surface section is larger than that of the side surface sections, and thus although a leading edge portion of the paper set in the paper feeder is misaligned, the misaligned leading edge portion thereof is able to pass smoothly through the entrance opening.

In this entrance structure, the angle of elevation of the side surface sections is preferably from about 20 to about 30 degrees, and the angle of elevation of the central surface section is preferably from about 40 to about 45 degrees. A plurality of guide elements may be provided at an outside edge boundary of the central surface section, so that the central surface section is extended further outward. When a continuous form paper having a maximum width of 330 mm is used, the width of the central surface section is preferably from about 200 to about 250 mm.

In accordance with another aspect of the present invention, there is provided an entrance structure for introducing a continuous form paper from a paper feeder into a printer, which structure comprises an entrance forming member disposed above a front end of the paper feeder and having a sloped guide surface defining an entrance opening for the paper, the sloped guide surface including side surface sections and a central surface section therebetween, the side surface sections having an angle of elevation with respect to the paper feeder and the central surface section being recessed from the side surface sections and having a triangular cross section, a ridge line of which has an angle of elevation with respect to the paper feeder; the angle of elevation of the ridge line being larger than that of the side surface sections.

In this entrance structure, the angle of elevation of the side surface sections is preferably from about 20 to about 30 degrees, and the angle of elevation of the ridge line of the central surface section is preferably from about 40 to about 45 degrees. A plurality of guide elements may be provided at an outside edge boundary of the central surface section, so that the central surface section is extended further outward. When a continuous form paper having a maximum width of 330 mm is used, a width of the central surface section is preferably from about 200 to about 250 mm.

In accordance with yet another aspect of the present invention, there is provided an entrance structure for introducing a continuous form paper from a paper feeder into a printer, which structure comprises an entrance forming member disposed above a front end of the paper feeder and having a sloped single guide surface defining an entrance opening for the paper, the sloped single guide surface having an angle of elevation with respect to the paper feeder, and a plurality of guide elements provided at a central zone of an outside edge boundary of the sloped single guide surface, so that a central portion of the sloped single guide surface is extended further outward.

In this entrance structure, the angle of elevation of the sloped single guide surface is preferably about 20 to about 30 degrees. A width of the central zone of the outside edge at which the guide elements are provided is preferably about from 200 to about 250 mm when a continuous form paper having a maximum width of 330 mm is used. The angle of elevation of the sloped single guide surface may be about 20 to about 30 degrees.

BRIEF DESCRIPTION OF THE DRAWINGS

The objects and advantages of the present invention will be better understood from the following description, with reference to the accompanying drawings, in which.

DESCRIPTION OF THE PREFERRED EMBODIMENTS

Figure 1:
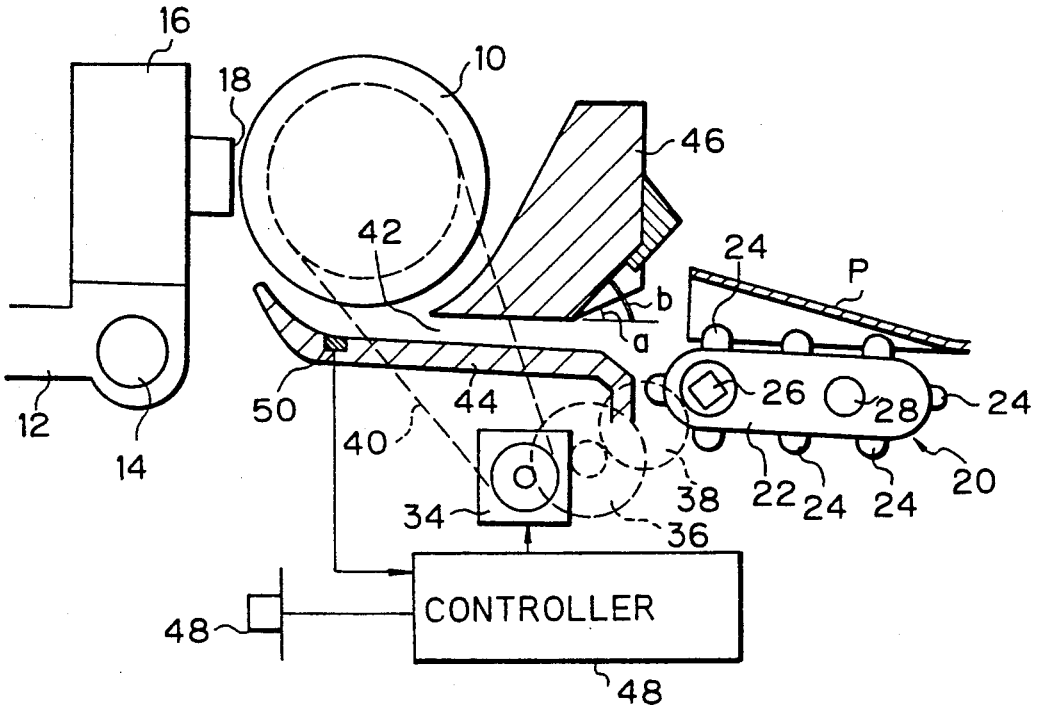
FIG. 1 is a schematic view of a printer in which the present invention is embodied.

FIG. 1 schematically shows a wire dot printer in which the present invention is embodied. This printer includes a platen 10 rotatably supported by side walls of a frame (not shown) of the printer, a carriage 12 slidably mounted on a guide rod 14 fixedly supported by the side wall of the printer frame (not shown), and a wire dot printing head 16 mounted on the carriage 12 so that a printing face 18 thereof faces and is close to a surface of the platen 10, to define a printing location therebetween. During a printing operation, the carriage 12 with the printing head 16 is reciprocatedly moved along a longitudinal axis of the platen 10.

Figure 2:
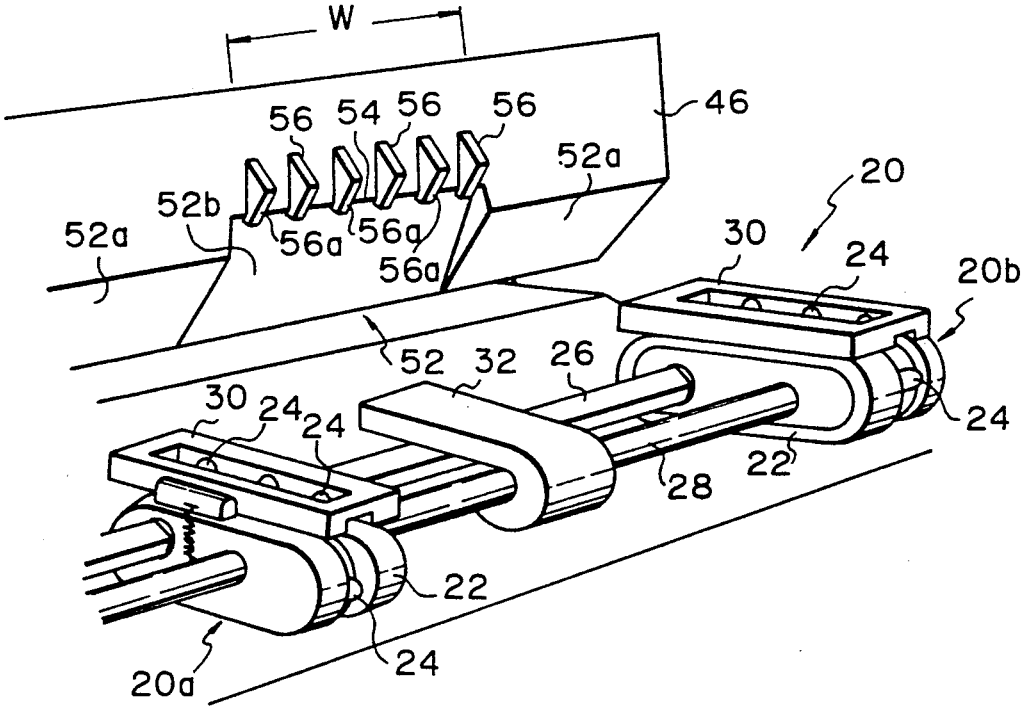
FIG. 2 is a partially enlarged perspective view of the printer shown in FIG. 1.

The printer is provided with a paper feeder or pin-belt tractor 20 for feeding a continuous form paper P to the printing location defined between the platen 10 and the printing face 18 of the printing head 16. As best shown in FIG. 2, the pin-belt tractor 20 includes a pair of pin-belt assemblies 20*a* and 20*b* having pins 24 which are engaged with two rows of perforations formed along the side margins of the continuous form paper P, respectively, as described below.

Namely, each of the pin-belt assemblies 20*a* and 20*b* includes frame members 22, drive and driven pulleys (not shown) provided in and rotatably supported by the frame members 22, and an endless belt entrained therebetween and having a plurality of pins 24 mounted thereon. The drive pulley is slidably mounted on a square cross-sectional shaft 26, which is rotatably supported by the side walls of the printer frame (not shown), and the driven pulley is slidably mounted on a round cross-sectional shaft 28 which is securely supported by the side walls of the printer frame (not shown). Due to the square cross section of the shaft 26, the drive pulleys cannot be rotated until the shaft 26 is rotationally driven, whereas the driven pulleys are rotatable around the round cross-sectional shaft 28.

The continuous form paper P is set in the pin-belt tractor 20 in such a manner that the two rows of the pins 24 of the pin-belt assemblies 22*a* and 22*b* are received in the two rows of the perforations of the side margins of the continuous form paper P. Note, when the continuous form paper P is set, a lid member 30 hinged to each frame member 22 is opened, and after the setting of the continuous form paper is completed, the lid member 30 is closed as shown in FIG. 2. As mentioned above, the pin-belt assemblies 22*a* and 22*b* are movable along the shafts 26 and 28 toward and apart from each other, so that a distance therebetween can be adjusted to conform to a width of the continuous form paper P.

As shown in FIG. 2, a guide member 32 is disposed between the pin belt assemblies 22*a* and 22*b* and is mounted on the shaft 28, so that a leading edge portion of the set continuous form paper P is prevented from drooping downward. This means that there is a tendency for the leading edge portion of the set continuous form paper P to be pushed upward, as shown in FIG. 1, in such a manner that a top of the leading edge portion is substantially positioned at a central point between the pin-belt assemblies 22*a* and 22*b*. The wider the width of the continuous form paper, the higher the top of the leading edge portion thereof is pushed upward. When the continuous form paper P has, for example, a width of 330 mm, the top of the leading edge portion may be pushed up to a maximum height of about 13 mm.

As shown in FIG. 1, the square cross-sectional shaft 26 is rotationally driven by an electric motor 34 through the intermediary of gears 36 and 38, and this motor 34 also drives the platen 10 through an endless drive belt 40. By driving the motor 34, the continuous form paper P is moved toward the printing location through a guide path 42 defined by a guide plate 44 extended between the pin-belt tractor 20 and the printing location, by a guide member 46 cooperating with the guide plate 44, and by the platen 10. As illustrated, the guide member 46 is disposed above a front end of the pin-belt tractor 20, and forms a part of the printing housing. The motor 34 is controlled by a controller 48 including, for example, a microcomputer, and can be driven in two modes thereby.

The first mode in which the motor 34 is driven is used to automatically lead the set continuous form paper P to the printing location. In particular, when a loading switch 48 provided on an operating panel of the printer is turned ON, the motor 34 is continuously driven so that the set continuous form paper P is moved toward the printing location, and the motor 34 is stopped when a given time has elapsed after a leading edge of the continuous form paper P is detected by a sensor 50 incorporated in the guide plate 44, whereby the continuous form paper P is made ready for a printing operation. The other mode is used during the printing operation; i.e., the motor 34 is driven in such a manner that the continuous form paper is intermittently and successively fed to the printing location.

When the automatic loading of the set continuous form paper P to the printing location is carried out, it first must be smoothly introduced into an entrance opening of the guide path 42. Namely, although the leading edge portion of the set continuous form paper P is pushed upward as shown in FIG. 1, the raised leading edge portion thereof must smoothly pass through the entrance opening of the guide path 42, and accordingly the entrance opening of the guide path 42 is defined by a sloped guide surface 52 formed on the guide member 46. Note, from this viewpoint, the guide member 46 can be referred to as an entrance forming member. In the embodiment shown in FIGS. 1 and 2, the sloped guide surface 52 includes side surface sections **52*a* having an angle of elevation "a" with respect to the pin-belt tractor 20, and a central surface section 52*b* therebetween having an angle of elevation "b" with respect to the pin-belt tractor 20. The central surface section 52*b* is recessed from the side surface sections 52*a* so that the angle of elevation of the former is larger than that of the latter. For example, if the angle of elevation "a" of the central surface section 52*b* is from about 40 to about 45 degrees, the angle of elevation "b" of the side surfaces 52*a* is from about 20 to about 30 degrees. For example, when the entrance opening of the guide path 42 is designed such that a continuous form paper having a maximum width of 330 mm can be introduced thereinto, a width "w" of the central surface section 52*b* is preferably from about 200 to about 250 mm. This arrangement allows the continuous form paper having a maximum width of 330 mm to pass smoothly through the entrance opening of the guide path 42**.

When the top of the raised leading edge portion of the continuous form paper is pushed upward to a height such that it is jammed against an outside edge 54 boundary of the central surface section **52*b*, a plurality of guide elements 56 is provided at the outside edge 54 so that the central surface section 52*b* is extended further outward. Namely, each of the guide elements 56 has a guide face 56*a* having an angle of elevation of preferably about from 40 to about 45 degrees. With this arrangement, although the top of the raised leading edge portion of the continuous form paper is higher than a level of the outside edge 54, it can still pass smoothly through the entrance opening of the guide path 42**.

Figure 3:
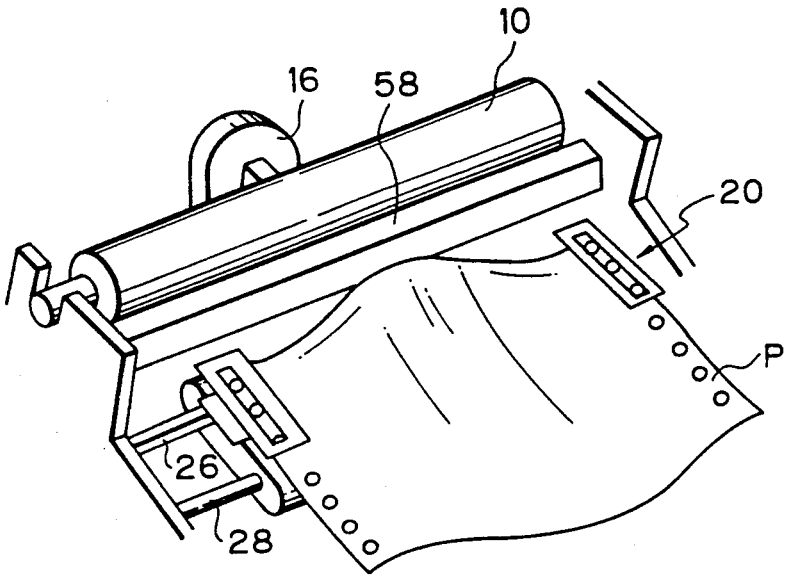
Fig. 3 PRIOR ART
FIG. 3 is a perspective view showing a printer having a prior entrance structure for a continuous form paper.
Figure 4:
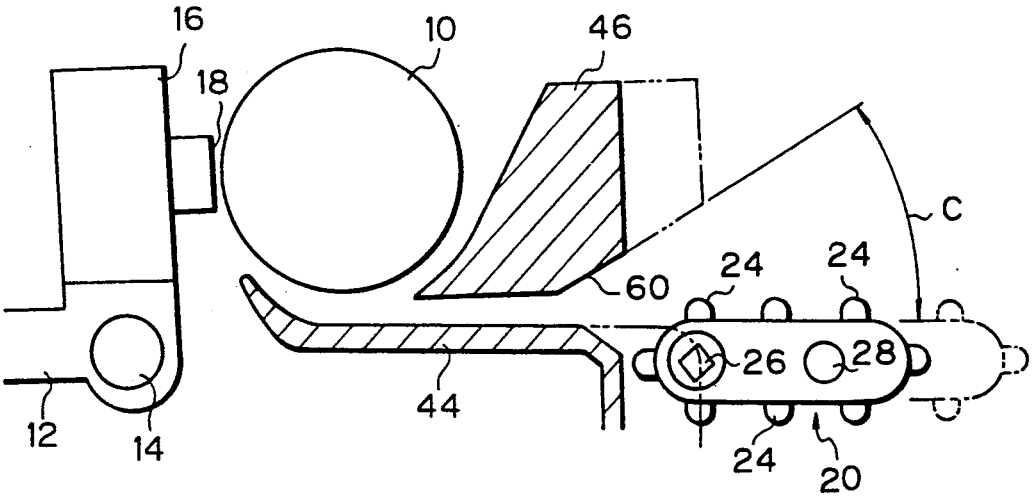
Fig. 4 PRIOR ART
FIG. 4 is a schematic view showing a printer having another prior entrance structure for a continuous form paper.

The merits or advantages of the present invention can be better understood by referring to FIGS. 3 and 4, showing the prior art in this field. In these drawings, elements similar to those of the printer shown in FIGS. 1 and 2 are indicated by the same reference numerals. In the prior art shown in FIG. 3, the entrance opening for the continuous form paper P is defined merely by a square cross-sectional rod member 58. As illustrated, when the leading edge portion of the continuous form paper P is pushed upward, the raised leading edge portion thereof cannot smoothly pass through the entrance opening because it becomes jammed against an outside edge of the rod member 58 by which the entrance opening is defined. In the prior art shown in FIG. 4, the entrance opening for the continuous form paper is defined by a sloped single guide surface 60 formed on the guide member 46 and having an angle of elevation "c" with respect to the pin-belt tractor 20, whereby although the leading edge portion of the continuous form paper is pushed upward, the raised leading edge portion thereof can pass smoothly through the entrance opening defined by the sloped guide surface 60.

Conventionally, the angle of elevation "c" of the sloped single guide surface 60 is from about 20 to about 30 degrees. In this case, the guide plate 44 and the guide member 46 must be extended as shown by chain dot lines in FIG. 4, before a continuous form paper having a relatively large width (for example, 330 mm) can pass smoothly through the entrance opening, because when the leading edge portion of the continuous form paper having the relatively large width is pushed upward, a top of the raised leading edge portion thereof has a large height. When the guide plate 44 and the guide member 46 are expanded, the pin-belt tractor 20 is shifted as shown by a chain dot line in FIG. 4, so that the continuous form paper can be easily set therein by an operator. If the angle of elevation "c" of the sloped guide surface is increased to a value within a range of from about 40 to about 45 degrees, it is unnecessary to expand the guide plate 44 and the guide member as shown by the chain dot lines, but the raised leading edge portion of the continuous form paper having a large width cannot pass through the entrance opening defined by the sloped guide surface having the angle of elevation of more than 40 degrees. Note, the raised leading edge portion of the continuous form paper having a relatively small width (for example, less than 250 mm) can pass smoothly through the entrance opening defined by the sloped guide surface having the angle of elevation of more than 40 degrees, because the top of the raised leading edge portion of the continuous form paper having a relatively small width has a relatively low height.

According to the embodiment shown in FIGS. 1 and 2, not only the raised leading edge portion of the continuous form paper having a relatively large width (more than 250 mm) but also the raised leading edge portion having a relatively small width (less than 250 mm) can pass smoothly through the entrance opening defined by the side surface sections **52*a* having the angle of elevation "a" and by the central surface section 52*b*** having the angle of elevation "b".

Figure 5:
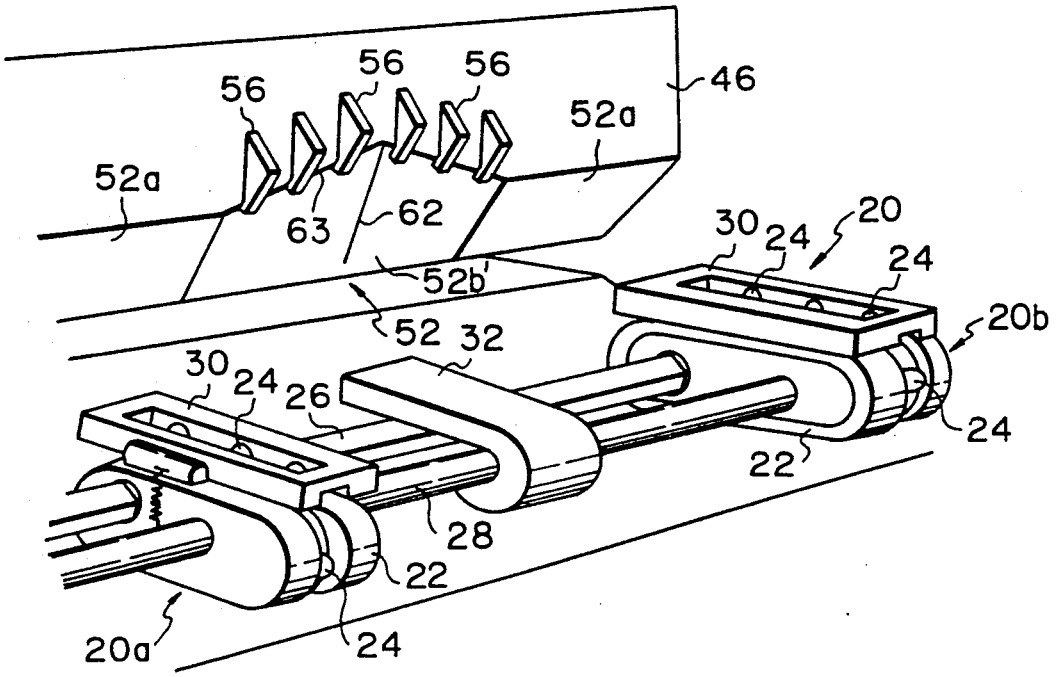
FIG. 5 is a perspective view corresponding to FIG. 2, showing another embodiment of the present invention.

FIG. 5 shows another embodiment of the present invention. In FIG. 5, elements similar to those shown in FIG. 2 are indicated by the same reference numerals. This embodiment is identical to that of FIG. 2 except that the central surface section **52*b*' is recessed from the side surface sections 52*a* such that the recess formed thereby has a triangular cross section, a ridge line 62 of which has an angle of elevation with respect to the pin-belt tractor 20. Note, similar to the central surface section 52*b* shown in FIG. 2, a width of the central surface section 52*b*' is preferably from about 200 to about 250 mm when a continuous form paper having a maximum width of 330 mm is used. The angle of elevation of the ridge line 62 is preferably from about 40 to about 45 degrees. The guide elements 56 are provided at an outside edge 63 boundary of the central surface section 52*b*'**, and thus this surface section is expanded further outward.

Figure 6:
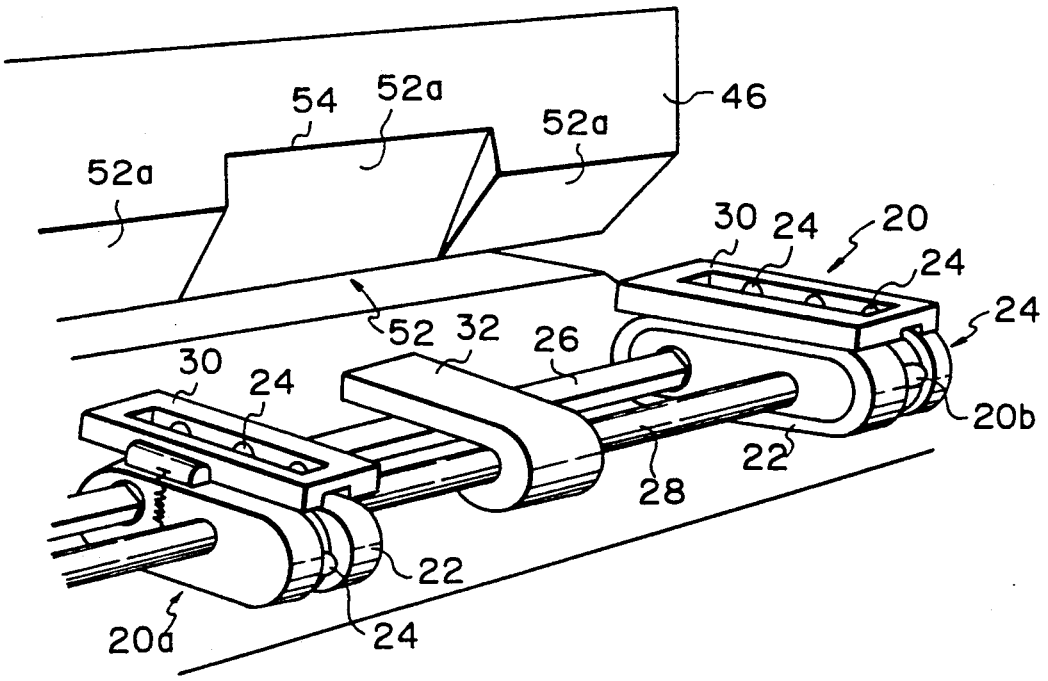
FIG. 6 is a perspective view corresponding to FIG. 2, showing a modification of the embodiment shown in FIGS. 1 and 2.

FIG. 6 shows a modification of the embodiment shown in FIGS. 1 and 2. In this modified embodiment, the guide elements 56 are omitted from the central surface section **52*b* because the top of the raised leading edge portion of the continuous form paper does not reach the level of the outside edge 56 boundary the central surface section 52***b*, the guide elements 56 are not necessary.

Figure 7:
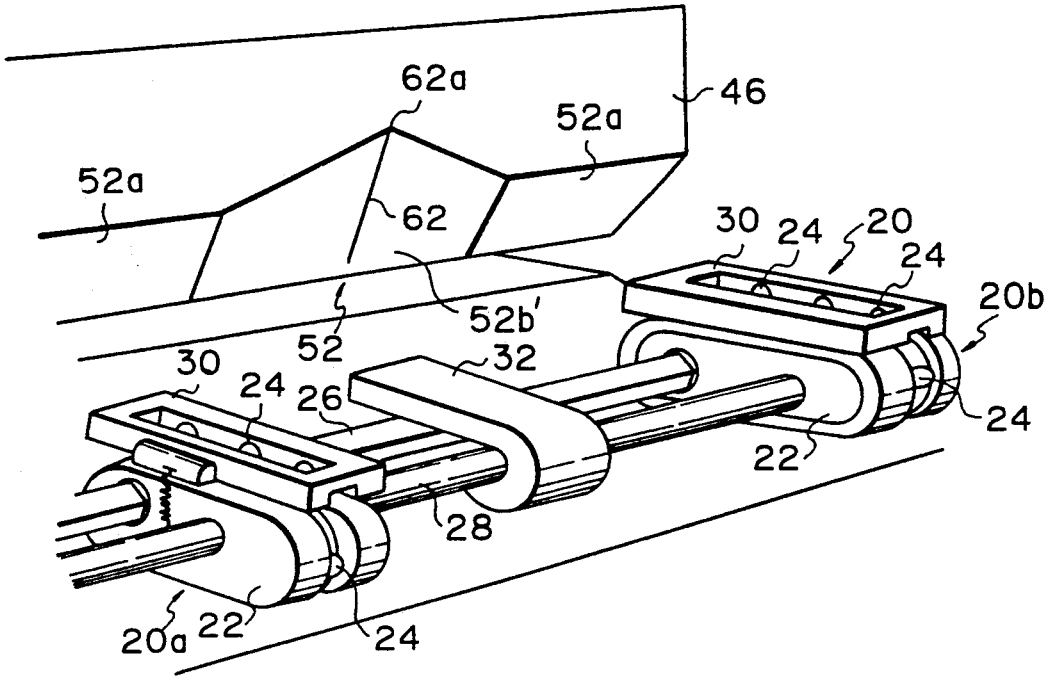
FIG. 7 is a perspective view corresponding to FIG. 2, showing a modification of the embodiment shown in FIG. 5.

FIG. 7 shows a modification of the embodiment shown in FIG. 5. In this modified embodiment, the guide elements 56 are omitted from the central surface section 52*b'* for the same reason as in FIG. 6. Namely, when the top of the raised leading edge portion of the continuous form paper does not reach a level of an apex 62*a* of the ridge line 62, the guide elements 56 are not necessary.

Figure 8:
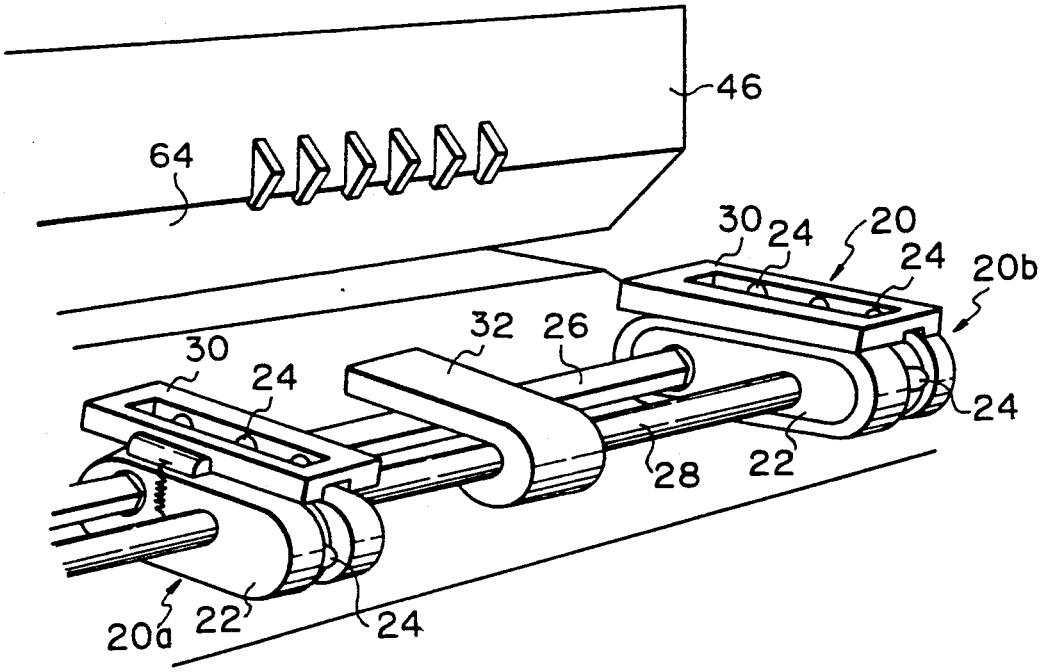
FIG. 8 is a perspective view corresponding to FIG. 2, showing yet another embodiment of the present invention.

FIG. 8 shows yet another embodiment of the present invention. In FIG. 8, elements similar to those shown in FIG. 2 are indicated by the same reference numerals. In this embodiment, the entrance opening for the continuous form paper is defined by a sloped single guide surface 64 formed on the guide member 46 and having an angle of elevation with respect to the pin-belt tractor 20. This angle of elevation is preferably from about 20 to 30 degrees. The sloped single guide surface 64 is characterized by the guide elements 56 provided at a central zone of an outside edge 54 boundary of the sloped single guide surface 64, so that a central portion of the guide surface 64 is extended further outward. When the continuous form paper having a maximum width of 330 mm is used, a width of the central zone at which the guide elements 56 are provided is preferably about from 200 to about 250 mm. In this embodiment, only the central portion of the guide surface 64 is extended by the guide elements 56, and thus the pin-belt tractor 20 can be positioned in the vicinity of the entrance opening, whereby the printer can be compactly arranged. Namely, when the continuous form paper is set in the pin-belt tractor by an operator, the guide elements 56 do not interfere with the setting operation because they are provided at only the central portion of the sloped guide surface 64.

In the embodiments as mentioned above, the guide member or entrance forming member 46 is formed as a part of the printer housing, but it also can be constructed as a separated part able to be attached to the printer housing.

Finally, it will be understood by those skilled in the art that the foregoing description is of preferred embodiments of the present invention, and that various changes and modifications thereof can be made without departing from the spirit and scope thereof.

I claim:

1. An entrance structure for introducing a continuous form paper from a paper feeder into a printer, which structure comprises an entrance forming member disposed above a front end of said paper feeder and having a sloped guide surface defining an entrance opening for the paper from the paper feeder, said sloped guide surface including side surface sections and a central surface section therebetween, which sections have different angles of elevation with respect to said paper feeder, respectively, and the angle of elevation of said central surface section being larger than that of said side surface sections, whereby although a leading edge portion of the paper set in said paper feeder is pushed upward, the raised leading edge portion of said continuous form paper is able to pass smoothly through said entrance opening.

2. An entrance structure as set forth in claim 1, wherein the angle of elevation of said side surface sections is from about 20 to about 30 degrees, and the angle of elevation of said central surface section is from about 40 to about 45 degrees.

3. An entrance structure as set forth in claim 1, wherein a plurality of guide elements is provided at an outside edge boundary of said central surface section, so that said central surface section is extended further outward.

4. An entrance structure as set forth in claim 3, wherein the angle of elevation of said side surface sections is from about 20 to about 30 degrees, and the angle of elevation of said central surface section is from about 40 to about 45 degrees.

5. An entrance structure as set forth in claim 1, wherein a width of said central surface section is from about 200 to about 250 mm when a continuous form paper having a maximum width of 330 mm is used.

6. An entrance structure as set forth in claim 5, wherein the angle of elevation of said side surface sections is from about 20 to about 30 degrees, and the angle of elevation of said central surface section is from about 40 to about 45 degrees.

7. An entrance structure for introducing a continuous form paper from a paper feeder into a printer, which structure comprises an entrance forming member disposed above a front end of said paper feeder and having a sloped guide surface defining an entrance opening for the paper, said sloped guide surface including side surface sections and a central surface section therebetween, said side surface sections having an angle of elevation with respect to said paper feeder, said central surface section being recessed from said side surface sections in such a manner that the recess formed thereby has a triangular cross section, a ridge line of which has an angle of elevation with respect to said paper feeder, the angle of elevation of said ridge line being larger than that of said side surface sections, whereby although a leading edge portion of the paper set in said paper feeder is pushed upward, the raised leading edge portion thereof is able to pass smoothly through said entrance opening.

8. An entrance structure as set forth in claim 7, wherein the angle of elevation of said side surface sections is from about 20 to about 30 degrees, and the angle of elevation of said ridge line is from about 40 to about 45 degrees.

9. An entrance structure as set forth in claim 7, wherein a plurality of guide elements is provided at an outside edge boundary of said central surface section, so that said central surface section is extended further outward.

10. An entrance structure as set forth in claim 9, wherein the angle of elevation of said side surface sections is from about 20 to about 30 degrees, and the angle of elevation of said ridge line is from about 40 to about 45 degrees.

11. An entrance structure as set forth in claim 7, wherein a width of said central surface section is from about 200 to about 250 mm when a continuous form paper having a maximum width of 330 mm is used.

12. An entrance structure as set forth in claim 11, wherein the angle of elevation of said side surface sections is from about 20 to about 30 degrees, and the angle of elevation of said central surface section is from about 40 to about 45 degrees.

* * * * *